US005729808A

United States Patent [19]

Bisaiji

[11] Patent Number: 5,729,808

[45] Date of Patent: Mar. 17, 1998

[54] IMAGE FORMING METHOD AND APPARATUS WHICH CONTROLS THE DISCHARGING OF TONER IMAGES BEFORE TRANSFER

[75] Inventor: Takashi Bisaiji, Yokohama, Japan

[73] Assignee: Ricoh Company, Ltd., Tokyo, Japan

[21] Appl. No.: 533,749

[22] Filed: Sep. 26, 1995

[30] Foreign Application Priority Data

Sep. 29, 1994 [JP] Japan ..... 6-235567

[51] Int. Cl.[6] ..... G03G 15/16

[52] U.S. Cl. ..... 399/296

[58] Field of Search ..... 355/272, 273, 355/275, 326 R, 327; 399/296, 45, 127, 128

[56] References Cited

U.S. PATENT DOCUMENTS

| | | | |
|---|---|---|---|
| 4,538,901 | 9/1985 | Soumiya | 355/273 |
| 4,931,839 | 6/1990 | Tompkins et al. | 355/271 X |
| 5,138,363 | 8/1992 | Yuge | 355/275 X |
| 5,189,478 | 2/1993 | Hara et al. | 355/271 |
| 5,204,716 | 4/1993 | Kasahara et al. | 355/275 X |

FOREIGN PATENT DOCUMENTS

| | | |
|---|---|---|
| 35 23 283 | 1/1986 | Germany . |
| 42 10 077 | 10/1992 | Germany . |
| 43 40 606 | 6/1994 | Germany . |

*Primary Examiner*—Robert Beatty

*Attorney, Agent, or Firm*—Oblon, Spivak, McClelland, Maier & Neustadt, P.C.

[57] ABSTRACT

In an electrophotographic image forming apparatus, a toner images are sequentially formed on an image carrier by toner of a plurality of colors. The toner images of different colors are sequentially transferred to a single transfer member one above the other to complete a color image. According to the number of colors that are to be transferred to the transfer member one above the other, the toner images on the image carrier are controllably discharged before the images are transferred to the transfer member. In addition, the toner images on the image carrier are controllably discharged according to whether the image originates from a computer or scanner.

18 Claims, 10 Drawing Sheets

IMAGE FORMING METHOD AND APPARATUS WHICH CONTROLS THE DISCHARGING OF TONER IMAGES BEFORE TRANSFER

BACKGROUND OF THE INVENTION

The present invention relates to an image forming method using an electrophotographic procedure, and a copier, printer, facsimile apparatus or similar image forming apparatus using the same.

Modern image forming apparatuses include one capable of forming a color image by using developers of different colors. This kind of apparatus is required to form toner images of three primary colors (cyan, magenta and yellow) particular to subtractive mixture on a single paper.

A color image forming apparatus may be constructed to sequentially form toner images of different colors on a photoconductive elements while sequentially transferring them to a paper one by one to complete a color image, as taught in, e.g., Japanese Patent Laid-Open Publication No. 52-73738. The problem with this type of apparatus is that the paper must have its edges clamped by a clamp mechanism and must be brought into contact with the photoconductive element several times during the course of image formation. This is not practicable without resorting to extremely complicate mechanisms. Moreover, images cannot be transferred to the clamped portions of the paper.

In light of the above, there has been proposed an image forming apparatus of the type sequentially forming toner images of different colors on a photoconductive element while sequentially transferring them to a single intermediate transfer member one above the other, and then transferring the resulting composite color image to a paper at a time. After the transfer of the color image from the intermediate transfer member to a paper, the toner remaining on the transfer member is removed by a cleaning blade or similar cleaning member. As a result, the transfer member is prepared for the next transfer of a composite color image. When the transfer member is implemented as a belt passed over a drive roller and driven rollers, it can be relatively freely arranged in a space and enhances the miniaturization of the entire apparatus.

Assume that toner of two or more different colors are combined to form a color image. Then, when toner of one color is superposed on toner of another color transferred first, the toner is sometimes scattered around the resulting color image. Much of the scattered toner exists in the vicinity of the edges of the image and causes the background to appear as if it were contaminated around the edges of the image. This kind of contamination concentrates on the portions surrounding the edges of the image. In this sense, such contamination is different from contamination which occurs evenly on the background. Particularly, when it comes to a character or similar line image, the above contamination blurs the contour of the image and thereby lowers sharpness. Moreover, when a greater amount of toner is deposited in order to increase the image density or when the edge effect available with modern digital copiers is enhanced to produce a sharp image, the contamination around the edges of an image is critical in respect of image quality.

By causing toner of two different colors to be transferred in the same amount, I found that the contamination around an image, as distinguished from background contamination, is attributable to the toner overlying the toner transferred first, i.e., the overlying toner partly drops from the underlying toner. I conducted a series of researches and experiments in order to determine the mechanism which brings about the above occurrence, as follows.

The factors effecting the mechanism is the history of the intermediate transfer belt, among others, and the history of the toner. As to the history of the belt, the belt is usually movable in contact with the surface of the photoconductive belt in order to receive toner images from the element. The belt is a semiconductor consisting of, e.g., a fluorine-contained resin and carbon or similar conductive substance mixed therewith; carbon sets up an electrical path for conducting a bias for image transfer. When the bias is applied to the belt, the belt electrostatically attracts the toner away from the photoconductive element and causes it to deposit thereon. As the belt moves away from position where it contacts the photoconductive element, a charge is induced due to separation discharge. This charge remains on the belt up to the time of the next image transfer. In this connection, charges remaining on the photoconductive element are dissipated by cleaning every time an image of one color is formed on the element. As a result, an electric field is generated on the belt at the boundary where a portion with the charge and a portion without the charge adjoin each other. This electric field causes the toner to be transferred next to electrostatically deposit on the belt easily.

As for the history of the toner, the toner transferred to the belt first is influenced by the transfer bias necessary for the electrostatic adhesion thereof to the belt. A bias potential assigned to the toner to be transferred next is higher than the transfer bias assigned to the toner transferred first. As a result, the two different toner are apt to repulse each other. This is partly because they are of the same polarity.

Experiments showed that the scattering of toner attributable to the above factors depends on the image forming mode also. Generally, a copy image forming mode and a printer image forming mode are available with an image forming apparatus. In the copy image forming mode, the apparatus serves as a copier and reads a document image, generates separated color image data representative of the image, and writes the image data. In the printer image forming mode, the apparatus serves as a printer and directly uses a signal received from a computer as data to write. In the copy image forming mode, the image data generated by color separation is 70% to 80% of the actual colors of a document image because usually the data is read out of the document image by an analog system. By contrast, in the printer image forming mode, 100% of image data is available because image data is output by a digital system. Hence, the amount of scattering of toner to occur when toner of different colors are superposed and, therefore, the reproducibility of an image depends on the kind of image data.

SUMMARY OF THE INVENTION

It is, therefore, an object of the present invention to provide an image forming apparatus capable of surely preventing, when toner images of two or more different colors are transferred, the toner to be superposed from being scattered around so as to obviate contamination around the edges of an image, and thereby guaranteeing sharp images.

In accordance with the present invention, a method of forming a color image consists of the steps of forming toner images on an image carrier by using toner of a plurality of colors, discharging the image carrier, and sequentially transferring the toner images formed by the respective toner from the image carrier to a single transfer member one above the other.

Also, in accordance with the present invention, an apparatus for forming a color image has a device for forming toner images on an image carrier by using toner of a plurality of colors, a device for discharging the image carrier, and a device for sequentially transferring the toner images formed by the respective toner from the image carrier to a single transfer member one above the other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
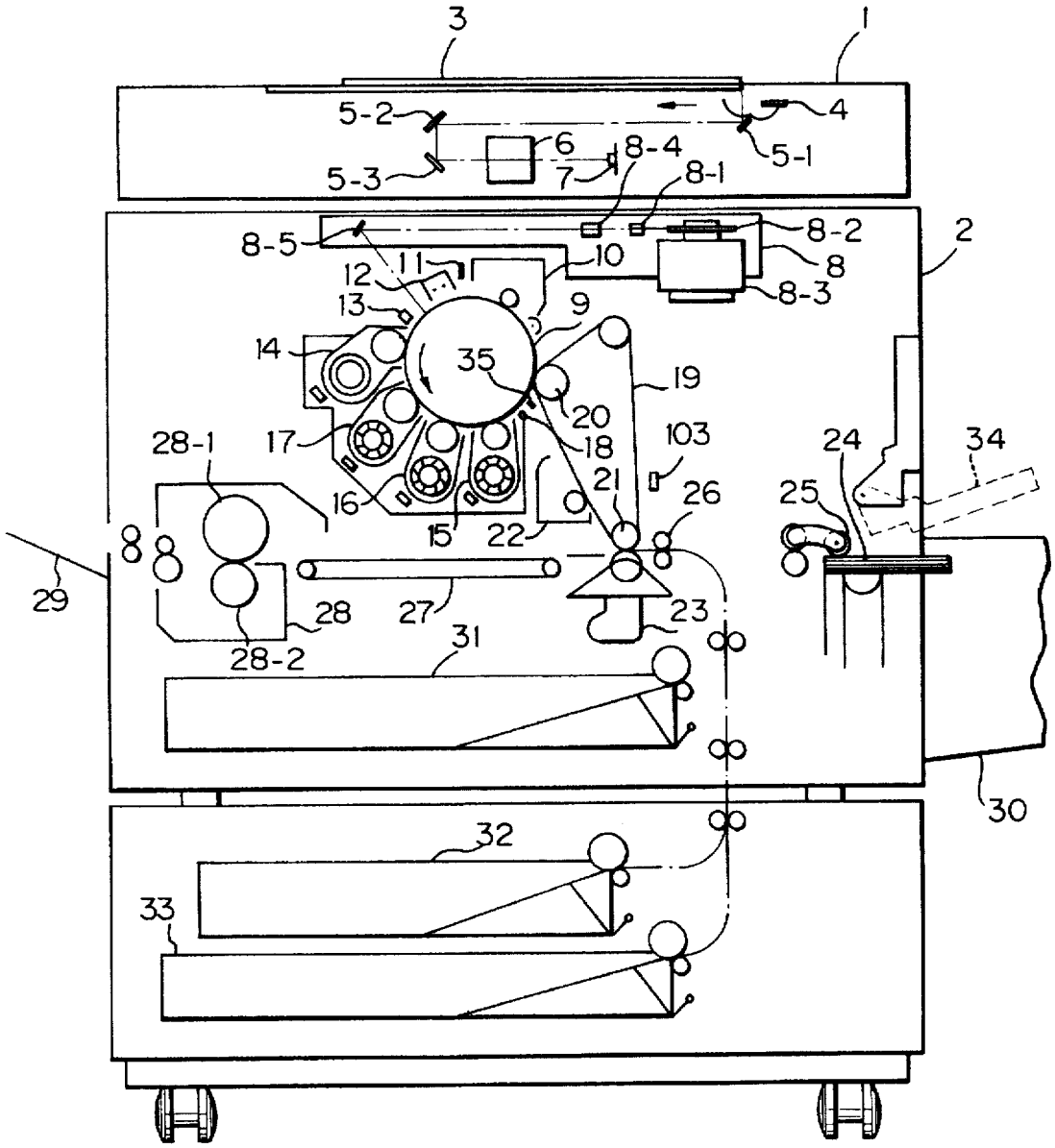
FIG. 1 is a section showing a specific image forming apparatus to which an image forming method of the present invention is applicable.

Referring to FIG. 1 of the drawings, an image forming apparatus to which an image forming method of the present invention is applicable is shown and implemented as a color copier by way of example. As shown, the copier is generally made up of a color image scanner 1 and a color printer 2. The scanner 1 has a lamp 4 for illuminating a document 3. The resulting reflection from the document 3 is incident to a color image sensor 7 via mirrors 5-1, 5-2 and 5-3, and a lens 6. The image sensor 7 reads the colors, e.g., blue (B), green (G) and red (R) of the incident imagewise light one by one, while converting them to electric image signals. The scanner 1 includes an image processing section, not shown, for producing black (BK), cyan (C), magenta (M) and yellow (Y) color image data on the basis of the intensity levels of the B, G and R image signals. The printer 2 prints out the BK, C, M and Y color image data by using BK, C, M and Y toner, respectively. The resulting toner images are sequentially superposed to complete a four-color or full-color image.

Specifically, the printer 2 has an optical writing unit for transforming the color image data fed from the scanner 1 to optical signals, and optically writing the document image represented by the optical signals. The writing unit has a laser 8-1 and a polygonal mirror 8-2. While the polygonal minor 8-2 is rotated by a motor 8-3, a laser beam issuing from the laser 8-1 is steered by the mirror 8-2 and incident to a photoconductive drum 9 via an f-theta lens 8-4 and a mirror 8-5. As a result, the laser beam electrostatically forms a latent image representative of the document image on the drum 9. The drum 9 is rotated counterclockwise, as indicated by an arrow in the figure. Arranged around the drum 9 are a drum cleaning unit (including a precleaning discharger) 10, a discharge lamp 11, a charger 12, a potential sensor 13, a BK developing unit 14, a C developing unit 15, a M developing unit, a Y developing unit 17, a density pattern sensor 18, an intermediate transfer member in the form of a belt 19, and other conventional units for effecting an electrophotographic copying cycle. A pretransfer discharger 35 is also positioned in the vicinity of the drum 9.

Figure 2:
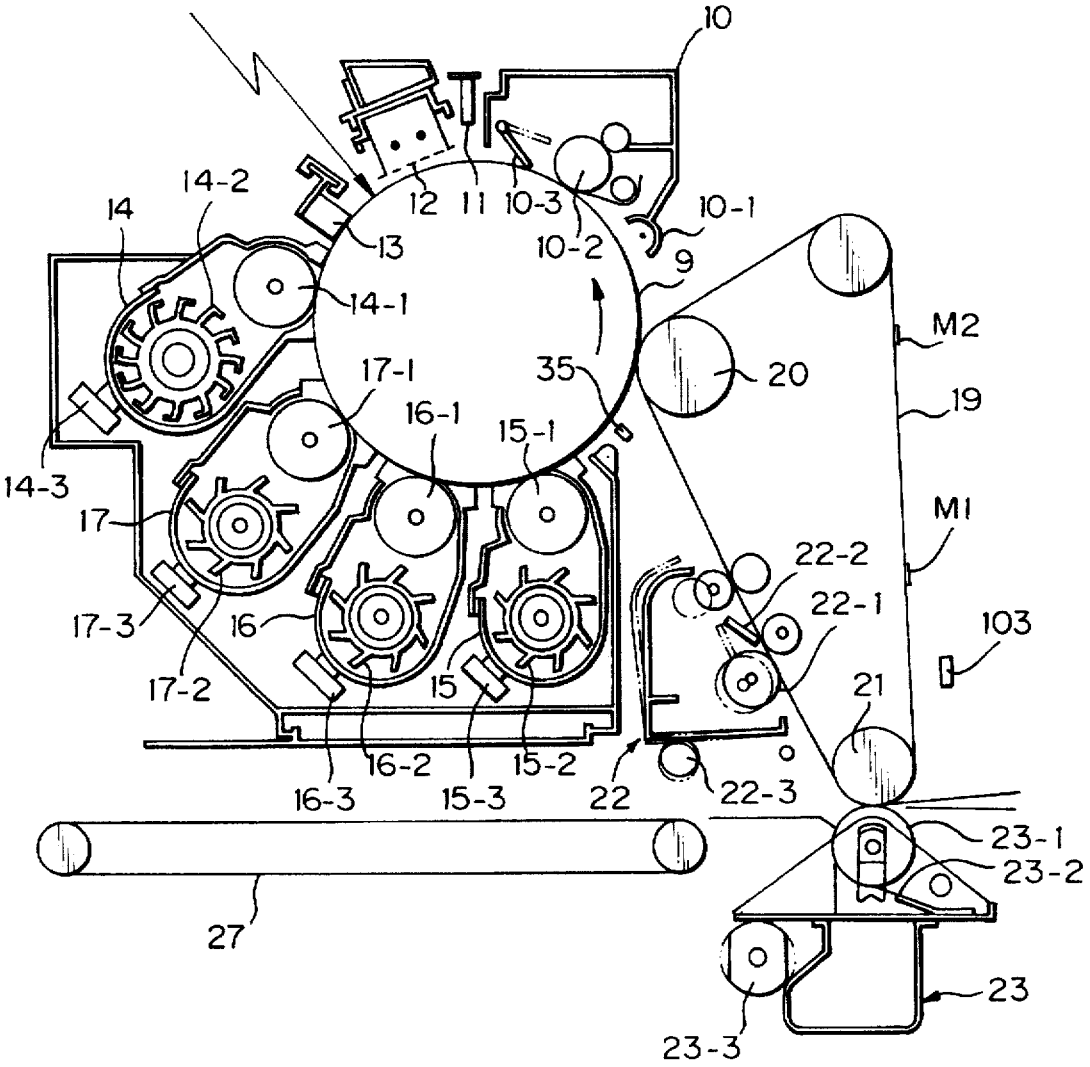
FIG. 2 is a fragmentary enlarged section of a part of the apparatus of FIG. 1 including a photoconductive element and an intermediate transfer belt.

As shown in FIG. 2, the developing units 14–17 respectively have sleeves 14-1, 15-1, 16-1 and 17-1, paddles 14-2, 15-2, 16-2 and 17-2, and toner concentration sensors 14-3, 15-3, 16-3 and 17-3. The sleeves 14-1 to 17-1 are rotatable and located to face the drum 9. The paddles 14-2 to 17-2 are each rotatable to scoop up a respective developer while agitating it.

The operation of the copier will be described on the assumption that a BK image, C image, M image and Y image are sequentially formed in this order, although such an order is only illustrative.

On the start of a copying operation, the scanner 1 starts reading BK image data out of a document at a predetermined timing. A laser beam starts forming a latent image on the basis of the BK image data. Let the latent image derived from the BK image data be referred to as a BK latent image. This is also true with latent images based on C, M and Y image data. In the BK developing unit 14, the sleeve 14-1 starts rotating before the leading edge of the BK latent image arrives at the developing position of the unit 14. In this condition, the developing unit 14 develops the BK latent image from the leading edge to the trailing edge with BK toner. As soon as the trailing edge of the BK latent image moves away from the developing position, the developing unit 14 is rendered inoperative. This is completed at least before the leading edge of the following C latent image reaches the developing unit 14.

The BK toner image formed on the drum 9 is transferred to the intermediate transfer belt 19 moving at the same speed as the drum 9. The image transfer from the drum 9 to the belt 19 will be referred to as belt transfer hereinafter. For the belt transfer, a predetermined bias voltage is applied to a bias roller 20 located at the position where the drum 9 and belt 19 contact each other. This position will be referred to as a belt transfer position hereinafter. The BK, C, M and Y toner images sequentially formed on the drum 9 are sequentially transferred to the same area of the belt 19 one above the other, thereby completing a full-color image on the belt 19. Subsequently, the full-color image bodily transferred from the belt 19 to a paper. The configuration and operation of a belt unit including the belt 19 will be described specifically later.

The BK image forming step effected with the drum 9 is followed by a C image forming step. The scanner 1 starts reading C image data out of the document at a predetermined timing. A laser beam forms a C latent image on the drum 9 in response to the C image data. In the C developing unit 15, the sleeve 15-1 starts rotating after the trailing edge of the BK latent image has moved away from the developing position of the unit 15, but before the leading edge of the C latent image arrives at the developing position. After the development of the C latent image, the developing unit 15 is rendered inoperative when the trailing edge of the latent image has moved away from the developing position. This is also completed before the leading edge of the following M latent image reaches the developing position.

A M latent image and a Y latent image are formed and developed in the same manner as the BK and C latent images. This will not be described specifically in order to avoid redundancy.

The belt unit including the intermediate transfer belt 19 is constructed and operated as follows. The belt 19 is passed over a drive roller 21, the previously mentioned bias roller 20, and a plurality of driven rollers (no numeral). The belt 19 is controllably driven by a stepping motor, not shown, via the drive roller 21, as will be described later.

As shown in FIG. 2, a belt cleaning unit 22 has a brush roller 22-1, a rubber blade 22-2, and a mechanism 22-3 for moving the unit 22 into and out of contact with the belt 19. During the belt transfer of the C, M and Y toner images following the belt transfer of the BK image, the mechanism 22-3 maintains the cleaning unit 22 spaced from the belt 19.

A paper transfer unit 23 has a bias roller 23-1, a roller cleaning blade 23-2, and a mechanism 23-3 for moving the unit 23 into and out of contact with the belt 19. The bias roller 23-1 is usually spaced from the belt 19. In the event when the full-color image formed on the belt 19 is transferred to a paper, the mechanism 23-3 urges the bias roller 23-1 against the belt 19 at a predetermining timing. In this condition, a preselected bias voltage is applied to the roller 23-1 in order to transfer the color image from the belt 19 to a paper.

As shown in FIG. 1, a paper 24 is fed to a registration roller 26 by a pick-up roller 25. The registration roller 26 drives the paper 24 toward a paper transfer position where the bias roller 23-1 faces the belt 19, at such a timing that the leading edge of the color image on the belt 19 reaches the paper transfer position.

After the belt transfer of the BK or first toner image up to the trailing edge, the belt 19 may be driven in any one of the following three different modes. If desired, the three modes to be described may be efficiently combined, depending on the copy size.

(1) Constant Speed Forward Mode

Even after the belt transfer of the BK image, the belt 19 is continuously moved at a constant speed. In this case, image processing is executed such that the leading edge of the next or C toner image developed on the drum 9 and the leading edge of the BK toner image on the belt 19 accurately meet each other. Specifically, the C latent image is formed on the drum 9 and developed at such a timing that the leading edge of the resulting C toner image arrives at the belt transfer position just when the leading edge of the BK toner image on the belt 19 reaches it. As a result, the C toner image is transferred to the belt 19 in accurate register with the BK toner image. Subsequently, the M and Y toner images are sequentially formed and transferred to the belt 19 in the same manner as the BK and C toner images, thereby completing a full-color image on the belt 19. Thereafter, the belt 19 is continuously moved forward to allow the full-color image to be transferred to the paper 24.

(2) Skip Forward Mode

After the belt transfer of the BK toner image, the belt 19 is moved away from the drum 9 and then moved in the same direction, but at a higher speed than during the belt transfer of the BK toner image. On moving a predetermined distance, the belt 19 is again driven at the usual speed and again brought into contact with the drum 9. This mode prevents the image forming cycle time at the drum 9 side from increasing and is executed when the length of the image is short relative to the length of the belt 19. Specifically, after the belt transfer of the BK toner image, the belt 19 is moved away from the drum 9 and then caused to skip forward at a high speed. On moving a predetermined distance, the belt 19 is again driven at the usual speed and again brought into contact with the drum 9. The C latent image is formed on the drum 9 and developed such that the leading edge of the resulting C toner image accurately meets the leading edge of the BK toner image when the latter is again brought to the belt transfer position. As a result, the C toner image is transferred to the belt 19 over and in accurate register with the BK toner image. This is followed by the belt transfer of the M and Y toner images. Thereafter, the belt 19 is continuously moved forward at the same speed to allow the full-color image to be transferred to the paper 24.

(3) Reciprocation (Quick Return) Mode

After the belt transfer of the BK toner image, the belt 19 is moved away from the drum 9 and then returned at a high speed. The belt 19 is brought to a stop at such a position that the BK toner image thereon will meet the C toner image carried on the drum 9. Subsequently, the belt 19 is again brought into contact with the drum 9 and moved in the same direction as the drum 9. This is repeated until the Y or last toner image has been transferred to the belt 19. In this manner, the belt 19 does not continuously move forward, but it simply returns the distance which it has moved forward. Considering such a small distance of movement of the belt 19, control for causing the image on the belt 19 and the image on the drum 19 to meet each other is simple. Specifically, after the belt transfer of the BK toner image, the belt 19 is moved away from the drum 9, stopped to move forward, and then returned at a high speed. As a result, the BK toner image on the belt 19 is passed through the belt transfer position in the reverse direction. On moving a predetermined distance, the belt 19 is brought to a stop. When the leading edge of the C toner image on the belt 19 reaches a predetermined position short of the belt transfer position, the belt 19 is again moved forward and again brought into contact with the drum 9. Again, the belt transfer is effected such that the C image is accurately superposed on the BK image on the belt 19. After the belt transfer of the Y or last toner image, the belt 19 is moved forward at the same speed to allow the full-color image to be transferred to the paper 24.

As shown in FIG. 1, the paper 24 carrying the full-color image thereon is conveyed by a conveying unit 27 to a fixing unit 28. In the fixing unit 28, a heat roller 28-1 controlled to a predetermined temperature and a press roller 28-2 cooperate to fix the toner image on the paper 24 with heat and pressure. The paper 24 coming out of the fixing unit 28 is guided to a copy tray 29.

After the belt transfer, the drum 9 is cleaned by the drum cleaning unit 10, i.e., precleaning discharger 10-1, brush roller 10-2 and rubber blade 10-3, and then uniformly discharged by the discharge lamp 11.

On the other hand, after the transfer of the full-color image from the belt 19 to the paper 24, the cleaning unit 22 is again urged against the belt 19 by the mechanism 22-3 and cleans the surface of the belt 19. In a repeat copy mode, the operation of the scanner 1 and the image formation on the drum 9 proceed from the step of forming the first Y (fourth color) toner image to the step of forming the second BK (first color) toner image at a predetermined timing. The second BK toner image is transferred to the area of the belt 19 which has been cleaned by the cleaning unit 22. This is followed by the procedure previously described in relation to the first BK toner image.

As shown in FIG. 1, paper cassettes 30, 31, 32 and 33 are each loaded with papers of particular size. Papers are sequentially fed from one of the cassettes 30–33 selected on an operation panel, not shown, toward the registration roller 26. The reference numeral 34 designates a manual feed tray available for OHP (Overhead Projector) sheets and thick sheets.

In a three-color or two-color copy mode, as distinguished from the full-color copy mode, the above procedure is repeated a number of times equal to the number of colors selected. In a single-color copy mode, one of the developing units matching a desired color is continuously held operative until a desired number of copies have been produced. In this case, the belt 19 is continuously moved forward at a constant speed in contact with the drum 9. Also, the belt cleaning unit 22 is held in contact with the belt 19.

Figure 3A:
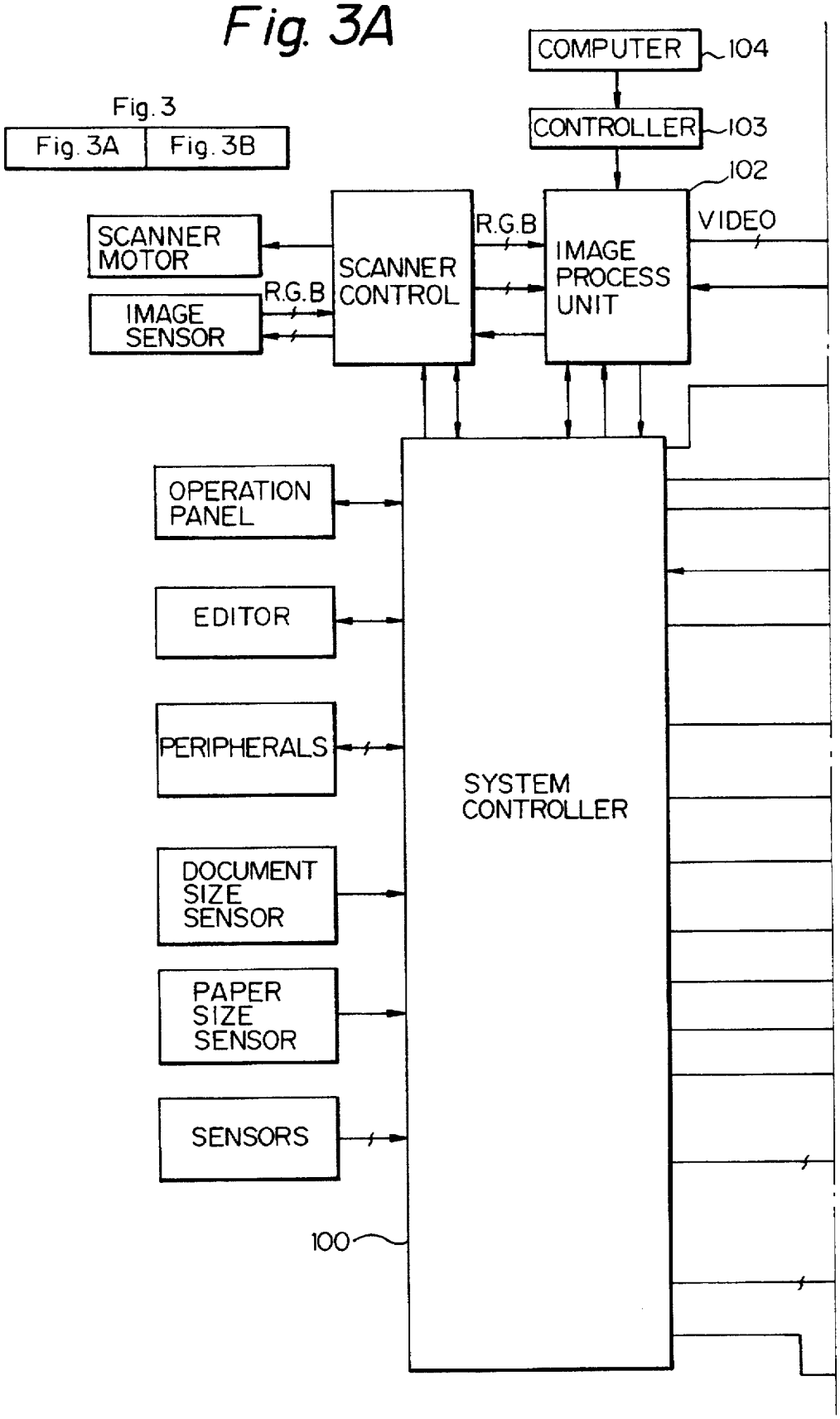
FIG. 3 is a block diagram schematically showing a control section applicable to the apparatus shown in FIG. 1.
Figure 3B:
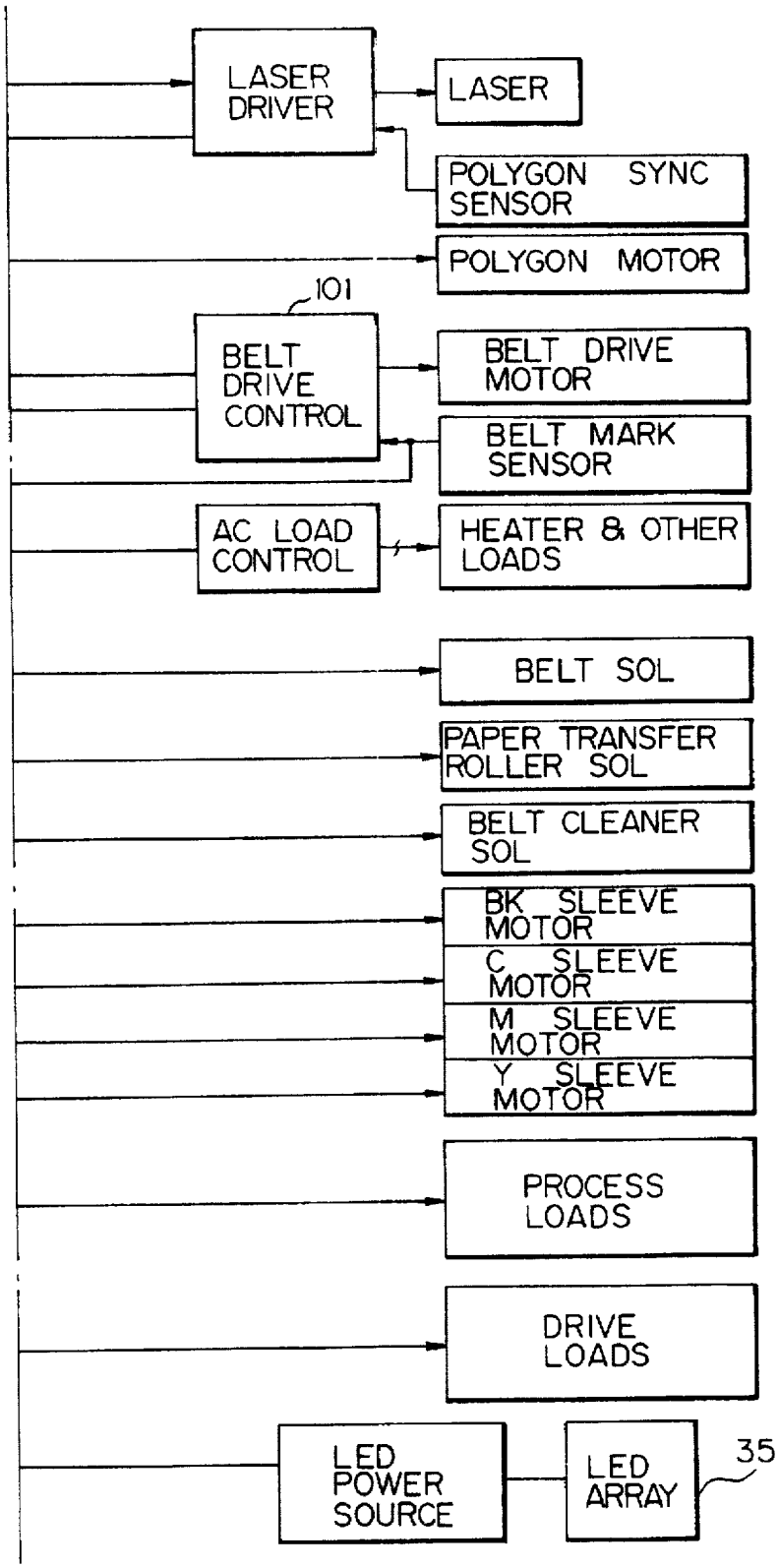

Referring to FIG. 3, a control section included in an image forming apparatus embodying the present invention is shown. The illustrative embodiment pertains to control over the pretransfer discharger 35. Hence, in FIG. 3, only the constituents relating to such control are designated by reference numerals, while the other constituents are simply represented by functions. As shown, the pretransfer discharger 35 is implemented by an LED (Light Emitting Diode) array extending in the axial direction of the drum 9. Each LED is connected to an LED drive power source 101 and caused to emit a predetermined quantity of light at a predetermined position. A system controller 100 controls the entire image forming procedure as well as the LED drive power source 101. For this purpose, the power source 101 is connected to the output side of the system controller 100.

An image processing unit 102 for processing image data is connected to the system controller 100. A scanner control section is connected to the image processing unit 102. A computer 104 is also connected to the image processing unit 102 via a controller 103. The processing unit 102 receives image data from the scanner control section or from the computer 104, selects a particular image forming mode matching the image data, and outputs it to the system controller 100. Specifically, the image forming mode is either the previously mentioned copy image forming mode for producing image data by use of the color scanner 2, or the printer image forming mode in which the image data from the computer 104 is directly input.

Figure 4:
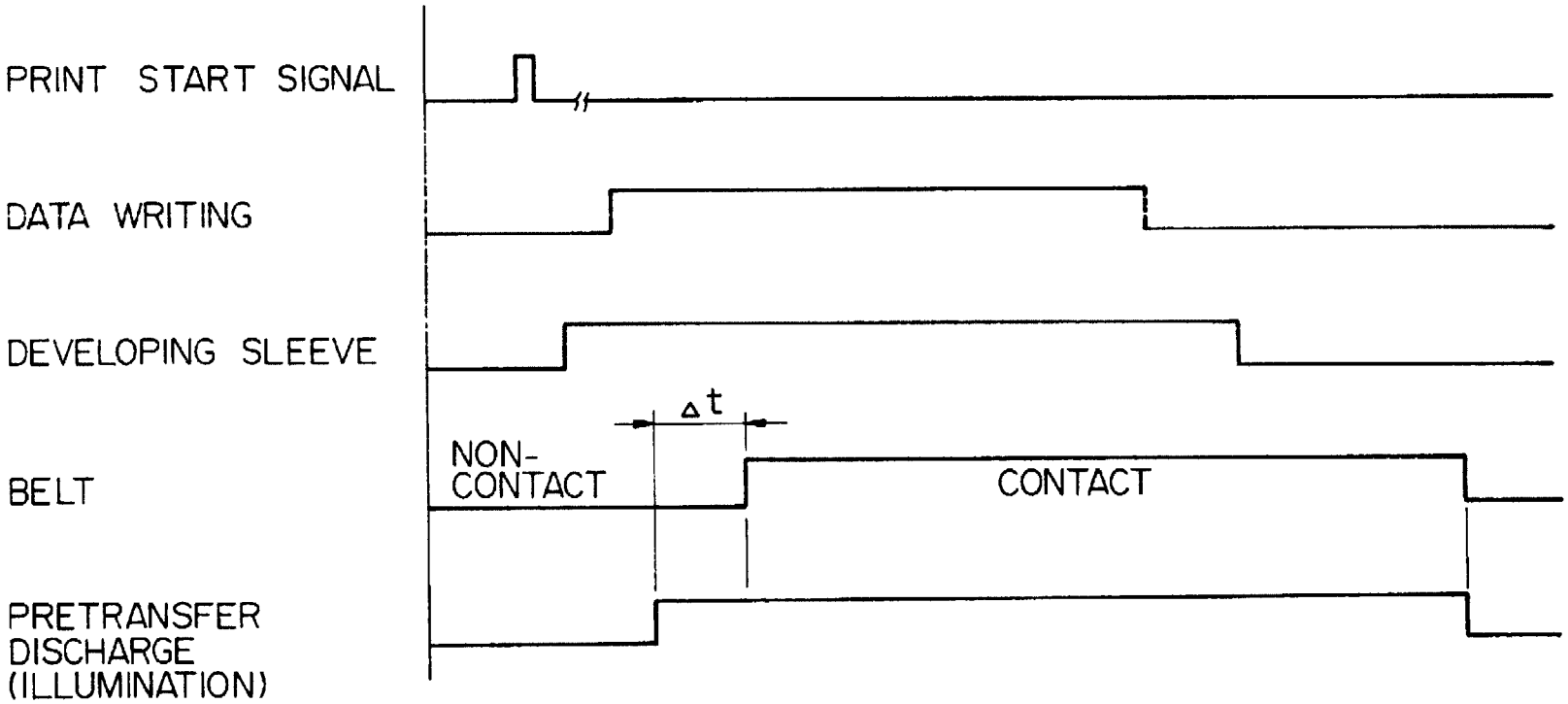
FIG. 4 is a timing chart demonstrating a specific operation of the control section.

The system controller 100 sets the emission timing of the pretransfer discharger or LED array 35. FIG. 4 is a timing chart showing an emission start timing applied to the previously stated quick return mode (3) available with the belt 19. As shown, the emission for pretransfer discharge begins during an interval $\Delta t$ before the belt 19 is brought into contact with the drum 9.

Figure 5:
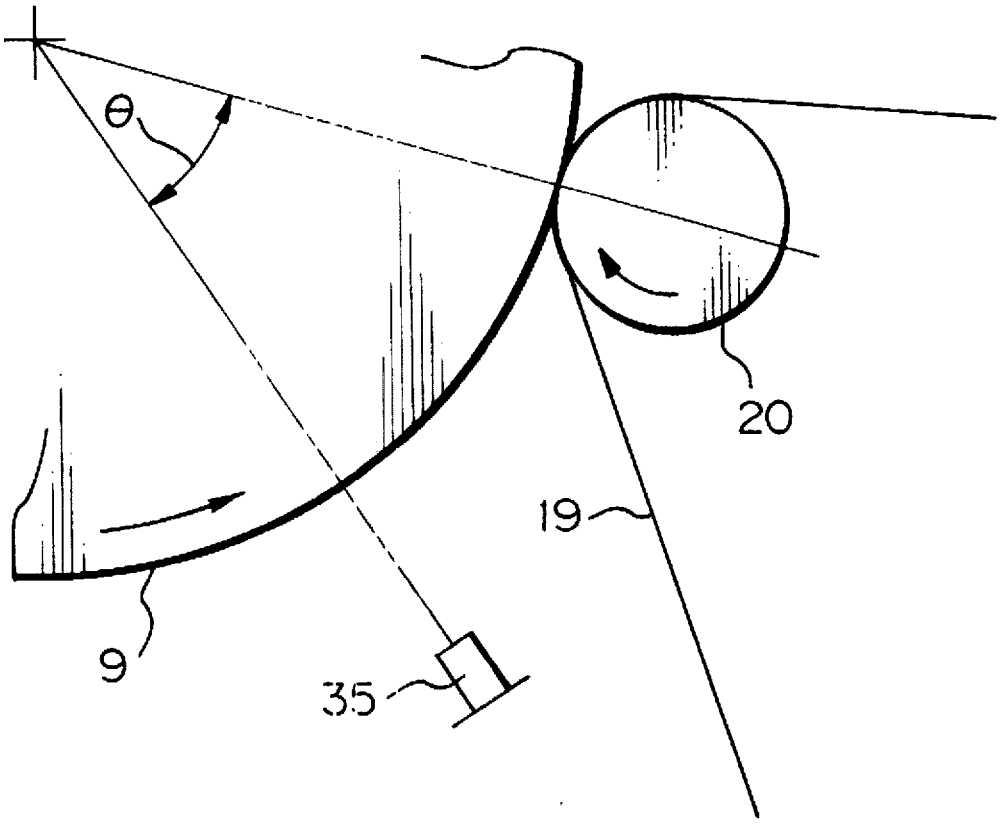
FIG. 5 is a diagram for describing a condition for setting a pretransfer discharge timing.

The above interval $\Delta t$ is preselected as follows. As shown in FIG. 5, the prerequisite is that the illumination for pretransfer discharge be meant for, among the toner transferred to the belt 19 before the next toner deposited on the drum 9 arrives at the belt transfer position, the toner transferred first or the toner to constitute an underlying layer. Assume that the center of the LED array 35 and the center of the belt transfer position have an angle $\theta$ therebetween. Then, the interval $\Delta t$ meeting the above prerequisite is expressed as:

$$\Delta t = 2\pi R/SP \times \theta/360 \text{(sec)}$$

where R is the radius (mm) of the drum 9, and SP is the process speed (mm/sec).

As the above equation indicates, because the belt 19 contacts the drum 9 before the leading edge of a toner image formed on the drum 9 reaches the belt transfer position, the toner image can be surely illuminated if the LED array 35 starts emitting $\Delta t$ (sec) earlier than the time when the belt 19 contacts the drum 9. On the other hand, the belt 19 is brought out of contact with the drum 9 after the toner image has been fully transferred to the belt 19. Hence, the LED array 35 must stop emitting at the same time as the belt 19 moves away from the drum 9.

A series of experiments were conducted to determine the scattering of toner on the basis of the above emission timing of the LED array 35 and by using toner of two colors for producing a color image, e.g., magenta toner and yellow toner for producing a red image. The results of experiments are listed in Table 1 below.

TABLE 1

| | Magenta | Yellow | Result |
|---|---|---|---|
| Example 1 | turn off | turn off | X |
| Example 2 | turn off | turn on | X |
| Example 3 | turn on | turn off | ○ |
| Example 4 | turn on | turn on | Δ |

In Table 1, a circle is representative of a condition wherein the background is almost free from visible contamination around the edges of an image (more than 80% satisfactory). A triangle is representative of a condition wherein good tonality achieved although some contamination, as clearly distinguished from background contamination, is observed in the background around the edges of an image (50% satisfactory). Further, a cross is representative of a condition wherein contamination in the background around the edges of an image is noticeable (not acceptable as an image).

The experiments were conducted under various conditions listed in Table 2below.

TABLE 2

| Conditions | | | | | |
|---|---|---|---|---|---|
| ① 1 Charge Potential on Drum Potential | Black | Cyan | Magenta | Yellow | |
| Image Portion (LD Data "255") | −110 | −100 | −100 | −120 | (V) |
| Non-Image Portion (LD Data "0") | −605 | −570 | −575 | −625 | (V) |
| ② Developing Bias | −455 | −420 | −425 | −475 | (V) |
| ③ Belt Transfer Bias | 1 C | 2 C | 3 C | 4 C | |
| | 1200 | 1300 | 1400 | 1500 | (V) |
| ④ Pretransfer Lamp | red LED (peak emission wavelength 6340 nm) | | | | |
| ⑤ Drum | OPC | | | | |
| ⑥ Belt | carbon-dispersed fluorine-contained resin volume resistivity $10^{10}$ Ω/cm surface resistivity $10^{9}$ Ω/cm$^2$ | | | | |
| ⑦ Process Speed | 180 mm/sec | | | | |
| ⑧ Developer | Black | Cyan | Magenta | Yellow | |
| Toner Concentration | 5.2 | 5.5 | 4.5 | 4.8 | (wt %) |
| Toner Charge | −18.5 | −20.3 | −19.0 | −21.6 | (μc/g) |
| ⑨ Image for Estimation | text image | | | | |

Although at first I expected that a good result was achievable with Example 2 of Table 1, Example 2 failed to prevent the toner from being scattered. Example 3 opposite to Example 2 as to the condition was successful. Example 4 is based on the results of Examples 2 and 3. When the LED array 35 was turned on for both the first color and the second color, as in Example 4, a result comparable with the result of Example 3 was not achieved. Example 1 is representative of the conventional condition. Thus, Examples 1–4 indicate that the scattering of toner is attributable to the history of the belt 19 as well as to the history of the toner.

When the LED array 35 is not turned on for the toner of the first color, the charge induced by separation discharge simply remains. As a result, an electric field is generated on the belt 19 and causes the next toner to electrostatically adhere to the belt 19. The toner transferred to the belt 19 first is deposited on the belt 19 under the influence of the necessary transfer bias. The next toner is electrostatically deposited on the belt 19 by a bias potential higher than the bias potential preselected for the first toner. Hence, if the charge potential deposited on the toner transferred to the belt 19 first is high, the toner transferred first and the toner transferred next are apt to repulse each other. This is partly because the first toner and the second toner are of the same polarity.

The LED array 35 is turned on and turned off in a particular manner based on the above findings and emission timing of the array 35. Table 3 shown below lists the ON/OFF conditions each matching a particular combination of the colors of toner.

TABLE 3

| | | Image Forming Order | | | |
|---|---|---|---|---|---|
| | | B K | C | M | Y |
| 1 Color Mode | B K | turn off | | | |
| | C | | turn off | | |
| | M | | | turn off | |
| | Y | | | | turn off |
| 2 Color Mode | R | | | turn on | turn off |
| | G | | turn on | | turn off |
| | B | | turn on | turn off | |
| Full Color Mode | | turn off | turn on | turn on | turn off |
| 3 Color Mode | | | turn on | turn on | turn off |

In Table 3, slashes indicate that an image forming mode is absent. As Table 3 also indicates, when a color image is formed by toner of two colors, the LED array 35 effects discharge before the toner to be transferred first is actually transferred to the belt 19. Particularly, when use is made of toner which the light from the array 35 is easy to permeate (except for black), the previously mentioned history of the belt 19 influences little. Hence, it is possible to reduce the influence of the electric field generated on the belt 19 and to act on the toner be transferred next, and, therefore to reduce the scattering of the next toner. In addition, because the potential difference between the toner transferred to the belt 19 and the toner to be transferred and, therefore, the repulsion acting therebetween is reduced.

When toner of two or more colors, e.g., toner of three colors or four colors (full color) are used, the LED array 35 performs illumination before the toner to be transferred first or the toner to underlie the toner to be superposed thereon is transferred to the belt 19. This is as desirable as the case wherein toner of two colors are used.

The system controller 100 executes, in addition to the above function, pretransfer discharge processing matching either the copy image forming mode or the printer image forming mode selected on an operation panel. In the copy image forming mode, images of a plurality of colors are formed by toner of respective colors on the basis of color data output from the scanner 1. In the printer image forming mode, a signal sent from the computer 104 is directly used as data to write. Furthermore, the system controller 100 selectively turns on or turns off the individual LEDs of the array 35, depending on whether or not an image portion formed by toner of a plurality of colors exists in the image forming area. Specifically, the system controller 100 controls the LED array 35 in accordance with the result of scanning performed by the scanner 1 in the main and subscanning directions. This kind of processing is relatively easy in, e.g., the printer image forming mode using the image data received from the computer 104. The processing reduces the optical fatigue of the drum 9 attributable to the illumination of the portions which do not need it.

The LED drive power source 101 sets the above emitting positions of the LED array 35 and, in addition, the quantity of light to issue from the array 35. The control over the quantity of light obviates an occurrence that the permeation of light changes with a change in the color and amount of toner to be transferred to the belt 19 and prevents the required discharging effect from being achieved. This can be done if the image processing unit 102 identifies the color of the toner to be transferred on the basis of the image data.

Figure 6A:
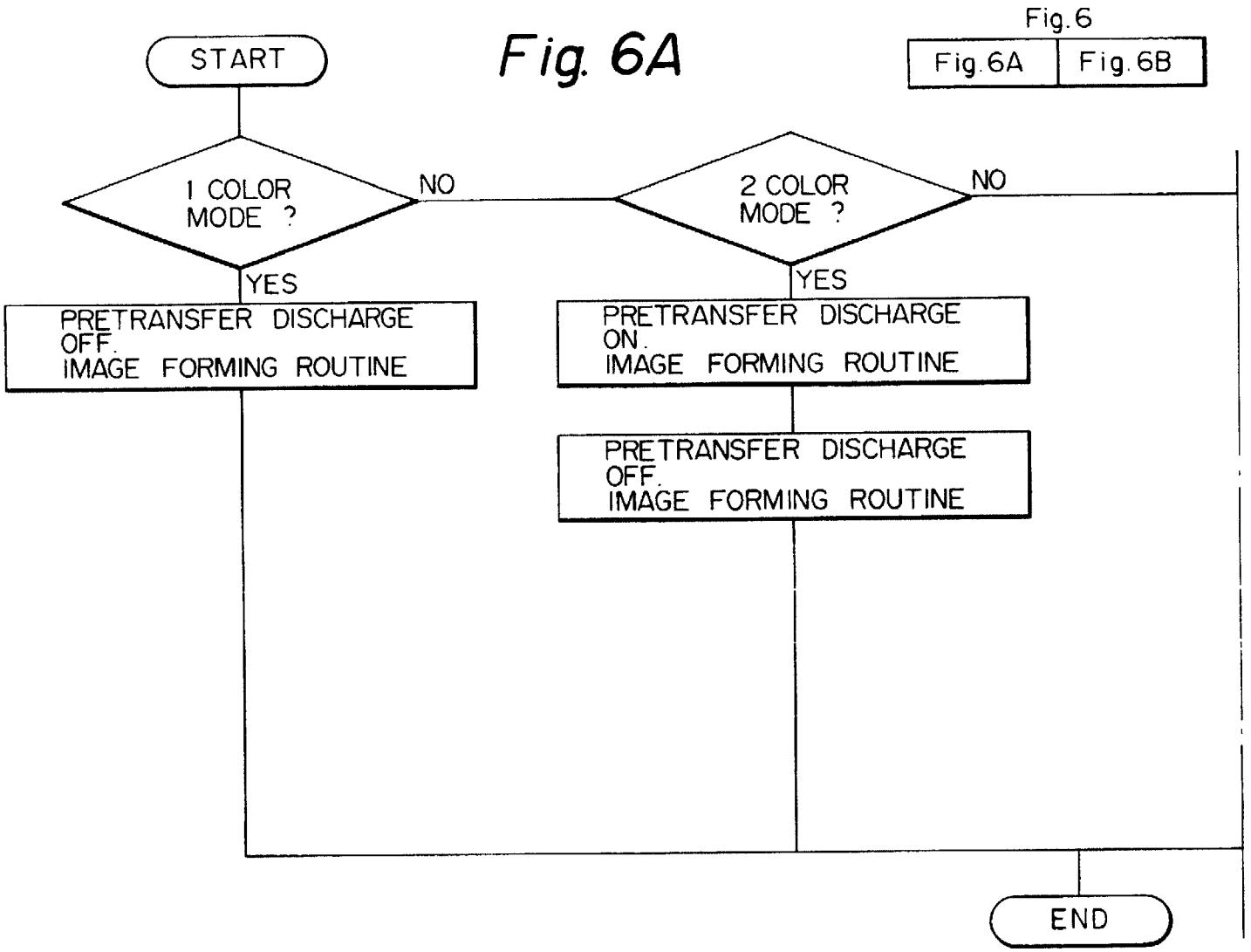
FIGS. 6 and 7 are flowcharts each demonstrating a particular operation of the control section shown in FIG. 3.
Figure 6B:
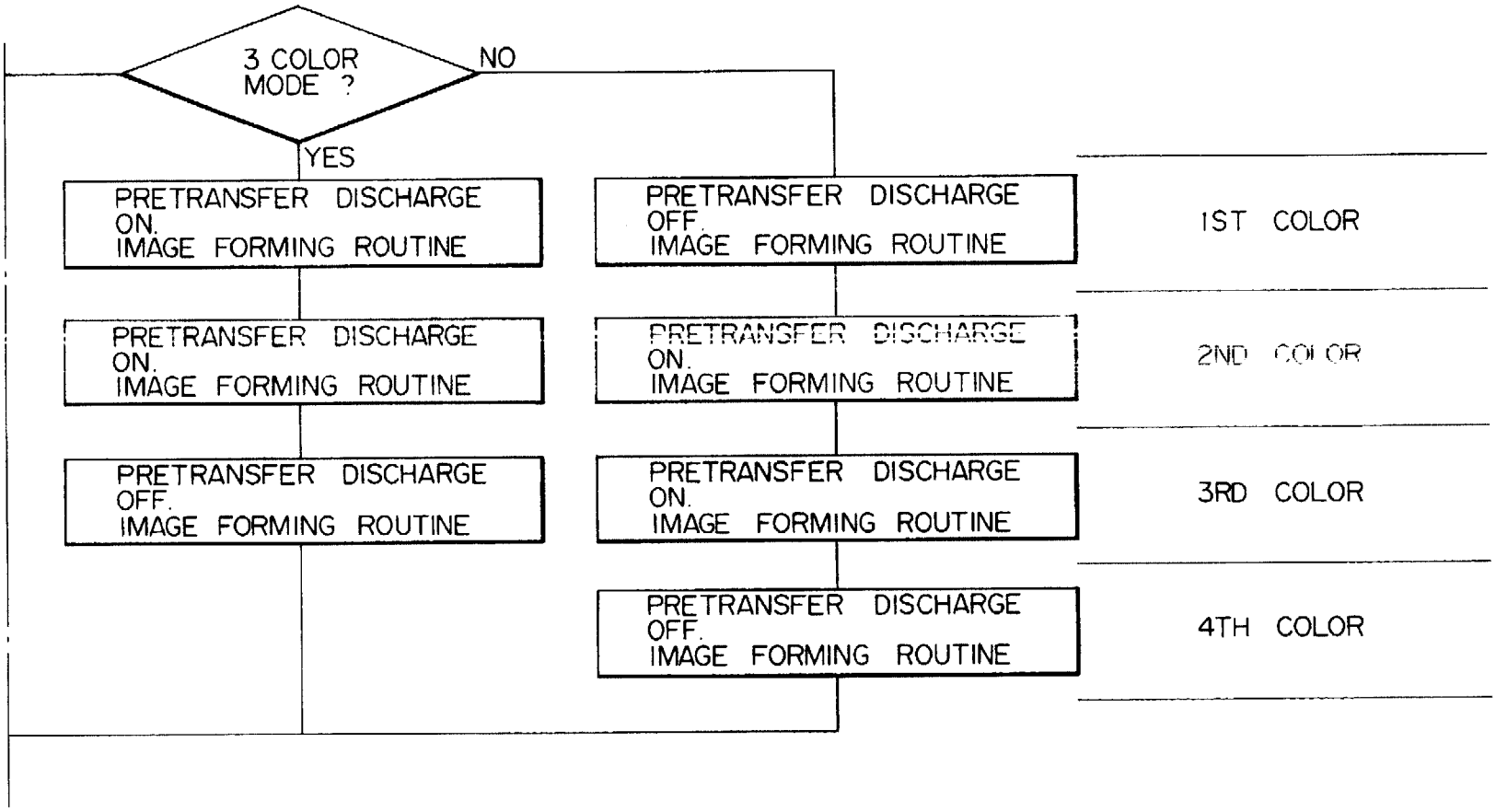
Figure 7A:
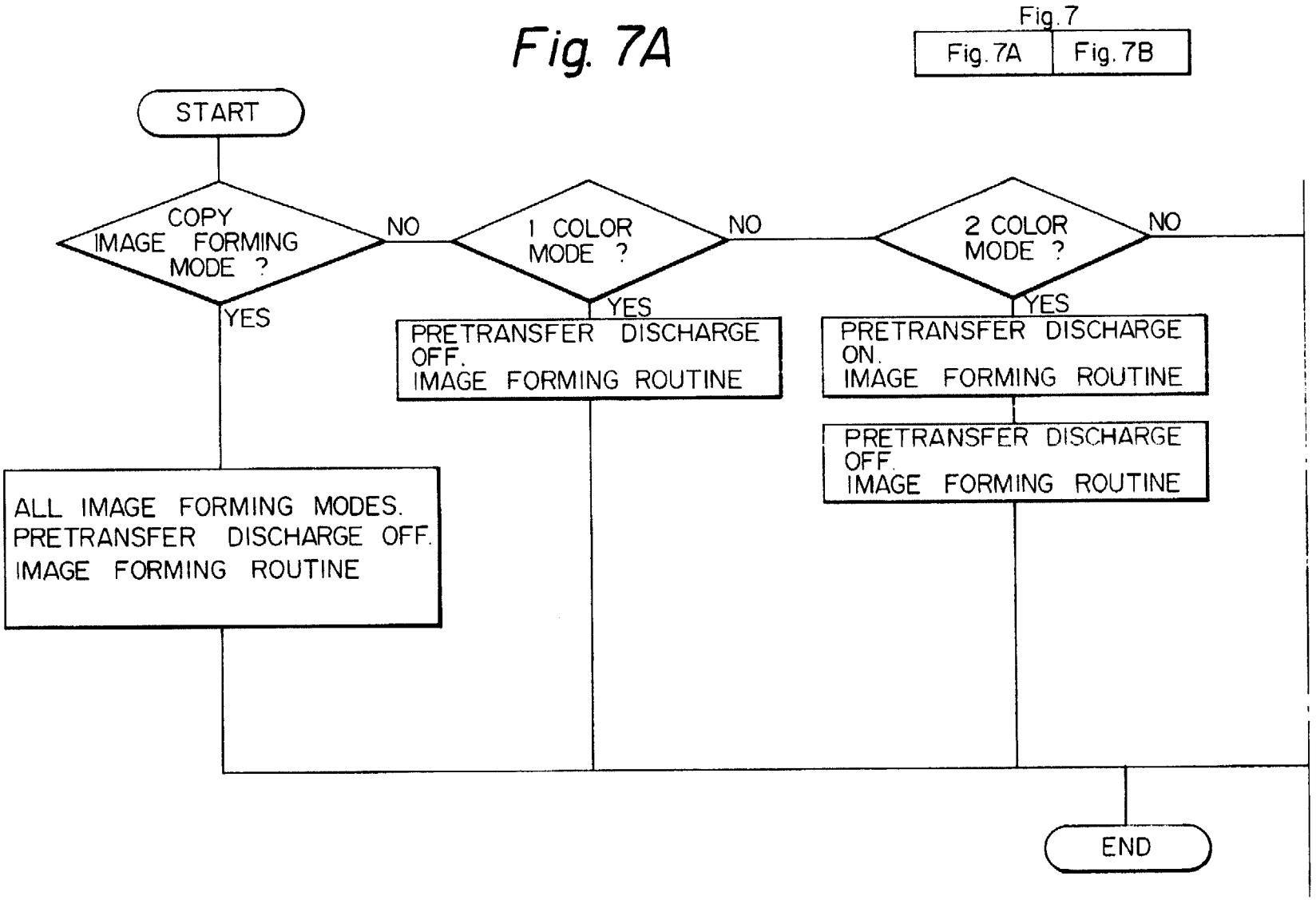
Figure 7B:
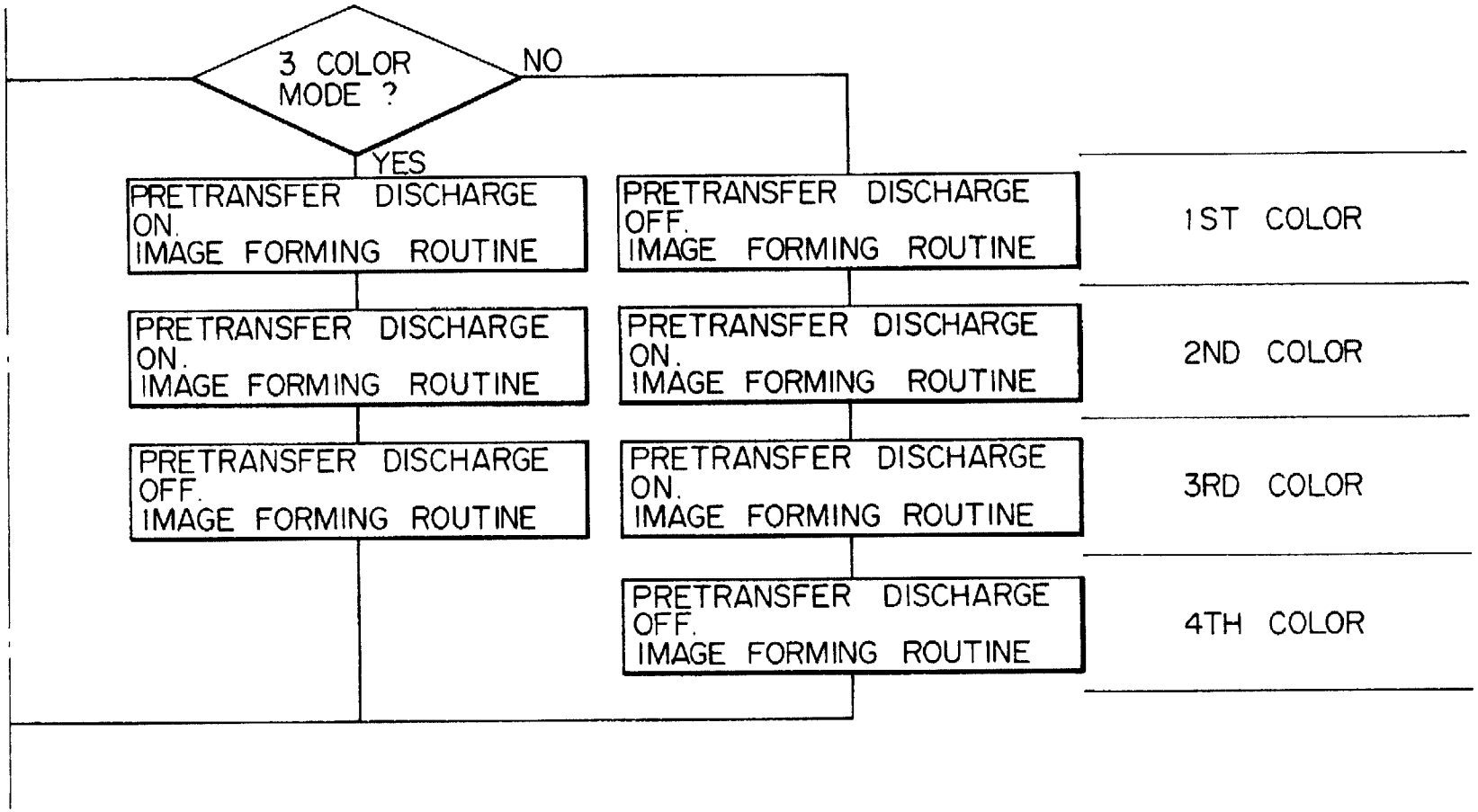

FIGS. 6 and 7 demonstrate specific operations of the system controller 100 which respectively occur when the copy image forming mode is selected and when the printer image forming mode is selected. In FIGS. 6 and 7, it is assumed that a BK image, C image, M image and Y image are sequentially formed in this order, as in FIGS. 1 and 2, as a specific procedure using two or more colors. Hence, when an image forming mode using a plurality of toner of different colors, including Bk toner, is selected, whether or not to effect the pretransfer discharge is determined for the toner other than the BK toner.

As shown in FIG. 6, the system controller 100 identifies a color mode entered on the operation panel. If a single-color mode is selected on the operation panel, the system controller 100, of course, does not effect the pretransfer discharge because toner to be superposed on another toner is absent. In a color mode other than the single color mode, the system controller 100 activates the LED array 35 before the toner to be transferred first or any toner to underlie the next toner is transferred to the belt 19. Assume that the printer image forming mode is selected, as shown in FIG. 7. Then, the system controller 100 determines the number of colors to be used and executes the pretransfer charge before the toner to be transferred first or any toner to underlie the next toner is transferred to the belt 19, thereby lowering the charge potential of the belt 19.

In summary, it will be seen that the present invention provides an image forming method and an image forming apparatus using it and each having various unprecedented advantages, as enumerated below.

(1) The charge potential of toner transferred first or to form an underlying layer is lowered by pretransfer discharged. As a result, the amount of charge to be induced by separation discharge is reduced. This successfully reduces the influence of an electric field generated on a transfer surface on toner to be discharged and thereby inhibits the toner from from electrostatic adhesion. Consequently, the toner is prevented from being scattered around. In addition, the decrease in the amount of charge attributable to separation discharge reduces repulsion to act between the toner to be superposed and the toner to underlie it, thereby preventing the former from being scattered around.

(2) The contents of pretransfer discharge are variable in matching relation to an image forming mode, i.e., copy image forming mode or printer image forming mode. This obviates the scattering of toner in a particular manner matching the image forming mode.

(3) The positions where the pretransfer charge is to be effected are selectable. Hence, a photoconductive element is protected from optical fatigue which would occur in the non-image portions thereof in the case of uniform illumination.

(4) Because LEDs suffice, the scattering of toner can be eliminated by a simple configuration.

Various modifications will become possible for those skilled in the art after receiving the teachings of the present disclosure without departing from the scope thereof. For example, when the amount of toner likely to overly another toner increases at least above a particular amount, the pretransfer discharge may be effected before the toner to be transferred first or the toner to underlie is transferred to the belt 19. This successfully reduces the scattering of the toner to be superposed even in a condition which is likely to aggravate the scattering.

What is claimed is:

1. A method for forming a multi-color image, comprising the steps of:

forming a first toner image on an image carrier;

discharging the first toner image which is on the image carrier;

transferring the first toner image to a transfer member;

forming a second toner image on the image carrier; and transferring the second toner image to the transfer member which carries the first toner image, without discharging the second toner image which is on the image carrier.

2. A method according to claim 1, further comprising the step of:

transferring the first and second toner images which are on the transfer member to a sheet of paper.

3. A method according to claim 1, further comprising the steps, which are performed after the step of transferring the first image and before the step of transferring the second image, of:

forming another toner image on the image carrier;

discharging said another toner image; and transferring said another toner image to the transfer member which carries the first toner image, wherein the step of transferring the second toner image comprises transferring the second toner image to the transfer member which carries both the first and said another toner images.

4. A method according to claim 1, further comprising the steps of:

forming an initial toner image on the image carrier, before forming the first toner image;

transferring said initial toner image to the transfer member without discharging said initial toner image which is on the image carrier;

forming a further toner image on the image carrier, after forming said initial toner image, after forming said first toner image, and before forming the second toner image;

discharging said further toner image; and transferring said further toner image to the transfer member which carries said initial toner image and said first toner image, wherein the step of transferring the second toner image comprises transferring the second toner image to the transfer member which carries said initial toner image, said first toner image, and said further toner image.

5. A method according to claim 1, further comprising the step of:

determining regions of the image carrier which are not to be discharged, wherein the discharging step comprises:

selectively discharging only regions of the image carrier without discharging said regions of the image carrier which are not to be discharged.

6. A method according to claim 1, further comprising the step of:

controlling the discharging based on the type of image which is being formed.

7. A method according to claim 6, wherein the controlling step comprises:

controlling the discharging based on whether the image to be formed originates as a print job from a computer or is a copy job which originates from a scanner.

8. A method for forming a multi-color image, comprising the steps of:

forming a first toner image on an image carrier;

selectively discharging only portions of the image carrier which contain the first toner image;

transferring the first toner image to a transfer member;

forming a second toner image on the image carrier; and transferring the second toner image to the transfer member which carries the first toner image.

9. A method for forming a multi-color image, comprising the steps of:

forming a first toner image on an image carrier;

controlling a discharging of the first toner image which is on the image carrier, depending on the type of image which is being formed;

transferring the first toner image to a transfer member;

forming a second toner image on the image carrier; and transferring the second toner image to the transfer member which carries the first toner image, wherein the controlling step comprises:

controlling the discharging based on whether the image to be formed originates as a print job from a computer or is a copy job which originates from a scanner.

10. A system for forming a multi-color image, comprising:

means for forming a first toner image on an image carrier;

means for discharging the first toner image which is on the image carrier;

means for transferring the first toner image to a transfer member;

means for forming a second toner image on the image carrier; and means for transferring the second toner image to the transfer member which carries the first toner image, without discharging the second toner image which is on the image carrier.

11. A system according to claim 10, further comprising:

means for transferring the first and second toner images which are on the transfer member to a sheet of paper.

12. A system according to claim 10, further comprising:

means for forming another toner image on the image carrier, after forming the first image but before forming the second image;

means for discharging said another toner image; and means for transferring said another toner image to the transfer member which carries the first toner image, wherein the means for transferring the second toner image comprises means for transferring the second toner image to the transfer member which carries both the first and said another toner images.

13. A system according to claim 10, further comprising:

means for forming an initial toner image on the image carrier, before forming the first toner image;

means for transferring said initial toner image to the transfer member without discharging said initial toner image which is on the image carrier;

means for forming a further toner image on the image carrier, after forming said initial toner image, after forming said first toner image, and before forming the second toner image;

means for discharging said further toner image; and means for transferring said further toner image to the transfer member which carries said initial toner image and said first toner image, wherein the means for transferring the second toner image comprises means for transferring the second toner image to the transfer member which carries said initial toner image, said first toner image, and said further toner image.

14. A system according to claim 10, further comprising:

means for determining regions of the image carrier which are not to be discharged, wherein the means for discharging comprises:

means for selectively discharging only regions of the image carrier without discharging said regions of the image carrier which are not to be discharged.

15. A system according to claim 10, further comprising:

means for controlling the discharging based on the type of image which is being formed.

16. A system according to claim 15, wherein the means for controlling comprises:

means for controlling the discharging based on whether the image to be formed originates as a print job from a computer or is a copy job which originates from a scanner.

17. A system for forming a multi-color image, comprising:

means for forming a first toner image on an image carrier;

means for selectively discharging only portions of the image carrier which contain the first toner image;

means for transferring the first toner image to a transfer member;

means for forming a second toner image on the image carrier; and means for transferring the second toner image to the transfer member which carries the first toner image.

18. A system for forming a multi-color image, comprising:

means for forming a first toner image on an image carrier;

means for controlling a discharging of the first toner image which is on the image carrier, depending on the type of image which is being formed;

means for transferring the first toner image to a transfer member;

means for forming a second toner image on the image carrier; and means for transferring the second toner image to the transfer member which carries the first toner image, wherein the means for controlling comprises:

means for controlling the discharging based on whether the image to be formed originates as a print job from a computer or is a copy job which originates from a scanner.

* * * * *